US010995467B2

(12) United States Patent
Abbondanza

(10) Patent No.: US 10,995,467 B2
(45) Date of Patent: May 4, 2021

(54) COMBINED WALL PILING SYSTEM

(71) Applicant: J.D. FIELDS & COMPANY, INC., Houston, TX (US)

(72) Inventor: Dean Abbondanza, Venice, FL (US)

(73) Assignee: J.D. FIELDS & COMPANY, INC., Houston, TX (US)

( * ) Notice: Subject to any disclaimer, the term of this patent is extended or adjusted under 35 U.S.C. 154(b) by 4 days.

(21) Appl. No.: 16/598,856

(22) Filed: Oct. 10, 2019

(65) Prior Publication Data

US 2020/0123730 A1 Apr. 23, 2020

Related U.S. Application Data

(60) Provisional application No. 62/748,074, filed on Oct. 19, 2018.

(51) Int. Cl.
*E02D 29/02* (2006.01)
*E02D 5/08* (2006.01)
(Continued)

(52) U.S. Cl.
CPC ..... *E02D 29/0266* (2013.01); *E02D 5/08* (2013.01); *E02D 5/28* (2013.01); *E02D 27/12* (2013.01);
(Continued)

(58) Field of Classification Search
CPC ..... E02D 5/08; E02D 5/28; E02D 2600/20; E02D 29/0266; E02D 27/12; E02D 2250/00; E02D 2300/0032
See application file for complete search history.

(56) References Cited

U.S. PATENT DOCUMENTS 2,009,542 A * 7/1935 Day ..... E01C 19/40 404/114
3,703,085 A * 11/1972 Wogerbauer ..... E02D 5/04 405/276
(Continued)

FOREIGN PATENT DOCUMENTS

CN 101358450 A 2/2009
CN 103649417 A 3/2014
(Continued)

OTHER PUBLICATIONS

Extended European Search Report issued in Application No. 19203491.6, dated Mar. 23, 2020; 8 pages.
(Continued)

*Primary Examiner* — Carib A Oquendo
(74) *Attorney, Agent, or Firm* — Adolph Locklar

(57) ABSTRACT

A king pile for a combined wall system includes a first flange, a second flange, and a web. The first flange has a first flange body that is a generally rectangular plate having a first edge, a second edge, and a face. A first king pile interlock is formed integrally with the first flange body at the first edge, and a second king pile interlock is formed integrally with the first flange body at the second edge. The king pile includes a second flange having a second flange body, the second flange body being a generally rectangular plate having a face. The king pile also includes a web. The web may be a generally rectangular plate that is coupled to the face of the first flange body and the face of the second flange body. The first flange, second flange, and web may be formed separately and coupled by welding.

19 Claims, 16 Drawing Sheets

(51) Int. Cl.
*E02D 5/28* (2006.01)
*E02D 27/12* (2006.01)

(52) U.S. Cl.
CPC .. *E02D 2250/00* (2013.01); *E02D 2300/0032* (2013.01); *E02D 2600/20* (2013.01)

(56) References Cited

U.S. PATENT DOCUMENTS 4,476,370 A * 10/1984 Kakihara ..... B23K 13/043 219/105
4,585,678 A * 4/1986 Kunito ..... E02D 5/04 405/267
5,351,990 A * 10/1994 Thomas ..... B62D 25/2054 280/789
2004/0093821 A1* 5/2004 Taenak ..... E02D 5/08 52/590.2
2007/0077129 A1* 4/2007 Hermes ..... E02D 5/08 405/278
2008/0145153 A1* 6/2008 Wendt ..... E02B 3/108 405/274
2014/0138427 A1* 5/2014 Nagatsu ..... E02D 5/28 228/264

FOREIGN PATENT DOCUMENTS

DE 9200021 U1 2/1992
DE 102014111657 A1 5/2015
JP S5634818 A 4/1981
WO 2005038148 A1 4/2005
WO 2010092746 A1 8/2010

OTHER PUBLICATIONS

Written Opinion issued in SG Application No. 10201909673X, dated Aug. 21, 2020; 4 pages.

* cited by examiner

400

| | |
|---|---|
| Wall Type | Single |
| ZZ Section | Any |
| $I_{nom}$ | 5900 |
| $S_{nom}$ | 70 |
| Maximum King Pile Depth | 45 |

| | $I_{nom}$, $S_{nom}$ Range | | | |
|---|---|---|---|---|
| | $I_{nom}$ | | $S_{nom}$ | |
| | Min | Max | Min | Max |
| Single | 850 | 5900 | 70 | 250 |
| Double | 1690 | 10300 | 130 | 410 |

| HZZ SYSTEM TABLE | Per Unit of Wall | | | | 60 ksi | 60 ksi | Mass: Beam/Sheet Ratio | | | Coating Area | |
|---|---|---|---|---|---|---|---|---|---|---|---|
| Configuration | Cross Sec. Area (A) | Moment Of Inertia (Iy) | Elastic Modulus (Sx) | Plastic Modulus (Sx) | Allow Bend. Moment *[No S.F.]* (Mmax) | | HZZ/ZZ 60% (m) | HZZ/ZZ 80% (m) | HZZ/ZZ 100% (m) | Waterside Surface (A') | Landslide Surface (A") |
| | $cm^2/m$ | $cm^4/m$ | $cm^3/m$ | $cm^3/m$ | kN-m/m | kN-m/m | $kg/m^2$ | $kg/m^2$ | $kg/m^2$ | $m^2/m$ | $m^2/m$ |
| | *$in^2/ft$* | *$in^4/ft$* | *$in^3/ft$* | *$in^3/ft$* | *kip-ft/ft* | *kip-ft/ft* | *$lbs/ft^2$* | *$lbs/ft^2$* | *$lbs/ft^2$* | *$ft^2/ft$* | *$ft^2/ft$* |
| 45_HZZT35/38-700 | 448.2 | 807457 | 13968 | 16523 | 5778 | 6260 | 298.8 | 325.1 | 351.4 | 2.67 | 5.97 |
| | 21.2 | 5913 | 259.8 | 307.3 | 1299 | 1407 | 61.2 | 66.6 | 72.0 | 8.74 | 19.57 |

FIG.14

COMBINED WALL PILING SYSTEM

CROSS-REFERENCE TO RELATED APPLICATIONS

This application is a non-provisional application which claims priority from U.S. provisional application No. 62/748,074, filed Oct. 19, 2018.

TECHNICAL FIELD/FIELD OF THE DISCLOSURE

The present disclosure relates generally to construction piling, and specifically to king pilings for combined wall piling systems.

BACKGROUND OF THE DISCLOSURE

A pile or piling is a structural member that is driven into the ground in order to serve as a foundation for a structure or to reinforce land or earthworks. Sheet pilings have been used for earth retention and support of excavation projects. Sheet pilings may be used to stabilize the ground or provide a solid barrier wall. Traditional sheet pilings include interlocking sheets of steel that form a continuous wall once installed into the ground. Later sheet piling installations, known as combi-walls, incorporated H-beams interspersed between the sheets and interlocking thereto to increase strength and weight efficiency. Typically, the H-beams, also known as king piles, are coupled to the sheets with a metal interlock connector that is welded to the hot-rolled H-beam at each interlock between the H-beam and an adjacent sheet. However, each interlock connector runs the entire length of the H-beam, both adding weight to the H-beam and complexity to the fabrication of the king pile.

SUMMARY

The present disclosure provides for a king pile for a combined wall system. The king pile may include a first flange. The first flange may include a first flange body, the first flange body being a generally rectangular plate having a length and a width. The first flange body may have a first edge, a second edge, and a face. The first flange may include a first king pile interlock positioned at the first edge of the first flange body and formed integrally therewith. The first flange may include a second king pile interlock positioned at the second edge of the first flange body and formed integrally therewith. The king pile may include a second flange. The second flange may have a second flange body, the second flange body being a generally rectangular plate having a face. The king pile may include a web. The web may be a generally rectangular plate. The web may be coupled to the face of the first flange body and the face of the second flange body.

The present disclosure also provides for a method of forming a king pile. The method may include forming a first flange. The first flange may include a first flange body, the first flange body being a generally rectangular plate having a length and a width. The first flange body may have a first edge, a second edge, and a face. The first flange may include a first king pile interlock positioned at the first edge of the first flange body. The first flange may include a second king pile interlock positioned at the second edge of the first flange body. the first flange formed such that the first king pile interlock and second king pile interlock are formed integrally with the first flange body. The method may include providing a second flange. The second flange may include a second flange body, the second flange body being a generally rectangular plate having a face. The method may include providing a web, the web being a generally rectangular plate. The method may include coupling the web to the face of the first flange body and coupling the web to the face of the second flange body.

The present disclosure also provides for a combined wall system. The combined wall system may include a king pile. The king pile may include a first flange. The first flange may include a first flange body, the first flange body being a generally rectangular plate having a length and a width. The first flange body may have a first edge, a second edge, and a face. The first flange may include a first king pile interlock positioned at the first edge of the first flange body and formed integrally therewith. The first flange may include a second king pile interlock positioned at the second edge of the first flange body and formed integrally therewith. The king pile may include a second flange. The second flange may have a second flange body, the second flange body being a generally rectangular plate having a face. The king pile may include a web. The web may be a generally rectangular plate. The web may be coupled to the face of the first flange body and the face of the second flange body. The combined wall system may include a sheet piling. The sheet piling may include an interlock connector, the interlock connector coupled to the first king pile interlock.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 14 depicts a graphical user interface for designing a king pile consistent with at least one embodiment of the present disclosure.

DETAILED DESCRIPTION

Figure 1:
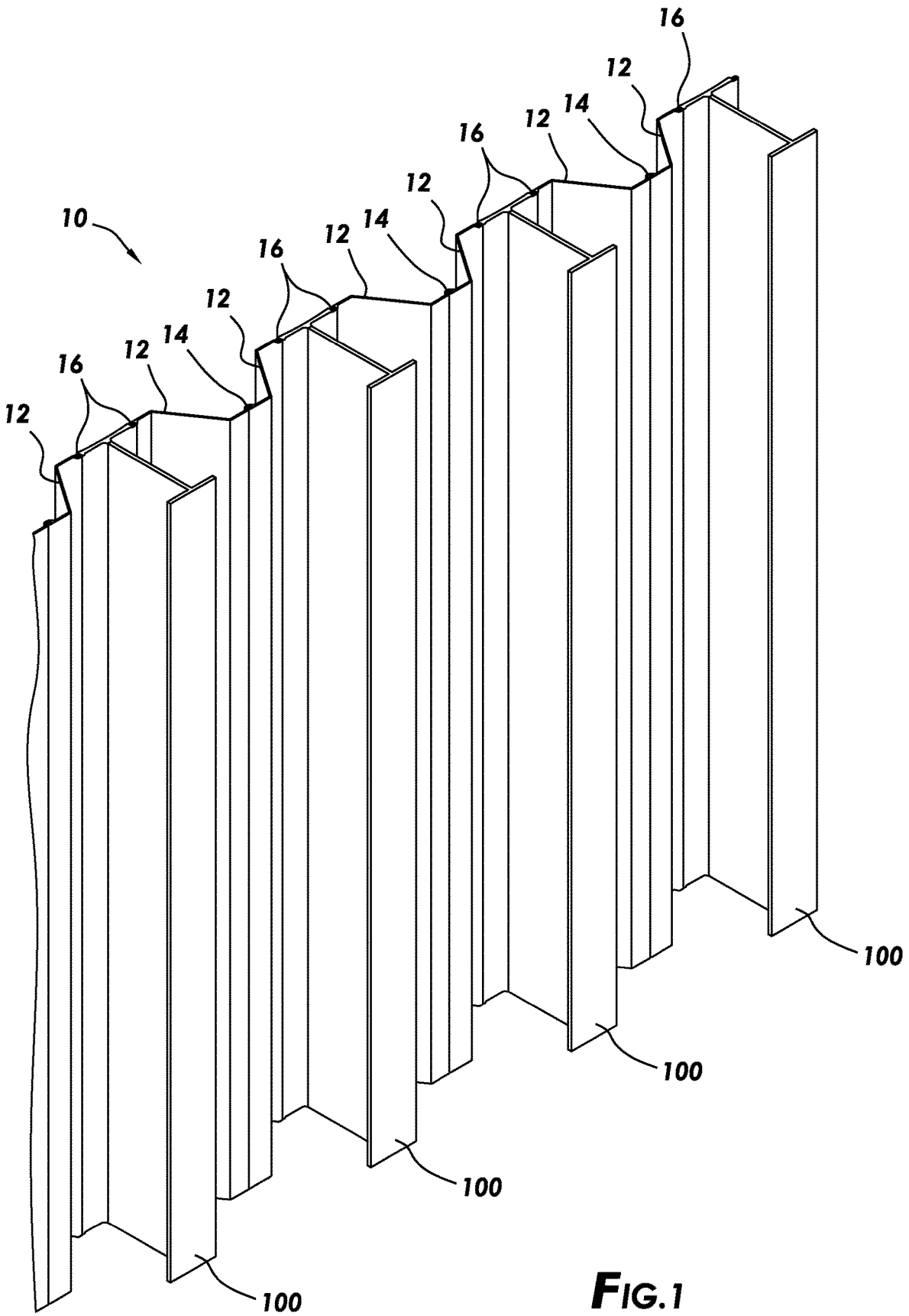
FIG. 1 depicts a combined wall system including king piles consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
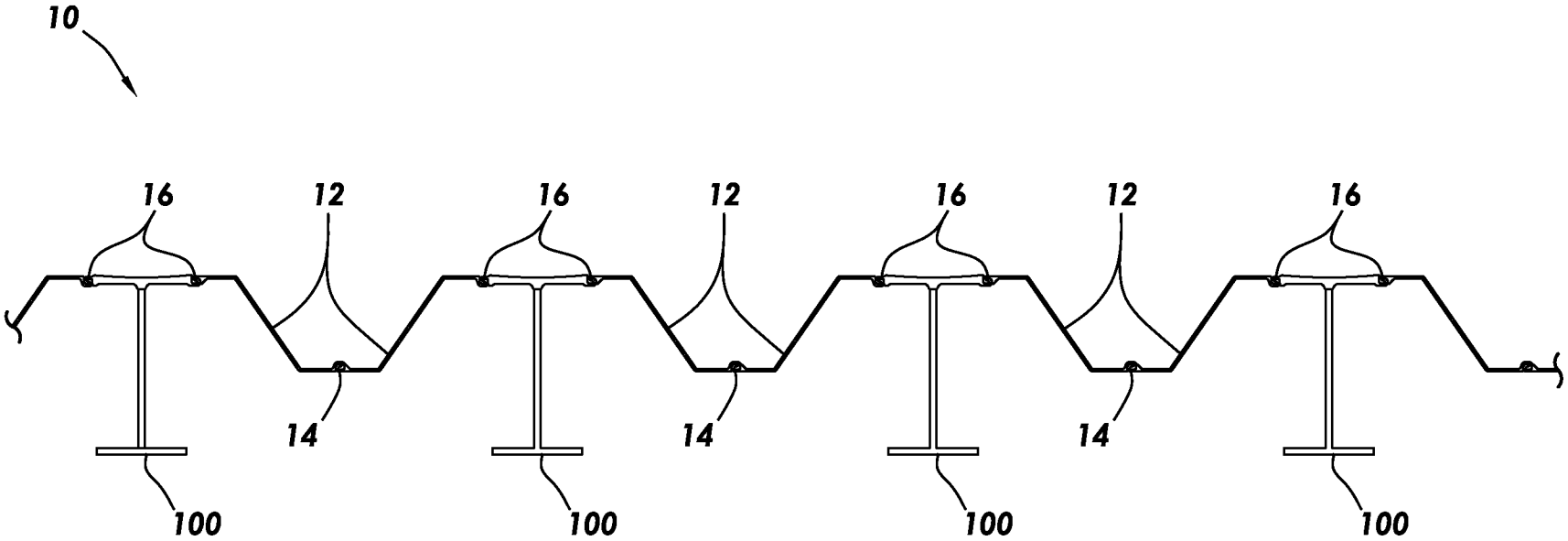
FIG. 2 depicts a top view of the combined wall system of FIG. 1.

FIGS. 1 and 2 depict combined wall system 10 consistent with at least one embodiment of the present disclosure. Combined wall system 10 may be constructed from sheet pilings 12 and king piles 100. Sheet pilings 12 and king piles 100 may be formed from a rigid material such as steel. Sheet pilings 12 and king piles 100 may be driven into the ground individually such that adjacent sheet pilings 12 are connected at the sheet interfaces and sheet pilings 12 are connected to an adjacent king piles 100 at king pile interfaces 16.

As shown in FIG. 2, each sheet piling 12 may include interlock connectors 14 positioned at each vertical edge of sheet piling 12. Interlock connectors 14 are designed such that adjacent sheet pilings 12 may be coupled together at the sheet interface by interlocking interlock connector 14 of a first sheet piling 12 to interlock connector 14 of a second sheet piling 12.

Each king pile 100 may include king pile interlocks 107*a*, 107*b*, discussed further herein below. King pile interlocks 107*a*, 107*b* are designed such that a sheet piling 12 may couple to king pile 100 at each king pile interface 16 using interlock connectors 14 respectively.

In some embodiments, interlock connectors 14 and king pile interlocks 107*a*, 107*b* may be, for example and without limitation, male and female Larssen interlocks, ball and socket interlocks, or finger and jaw interlocks.

Figure 3:
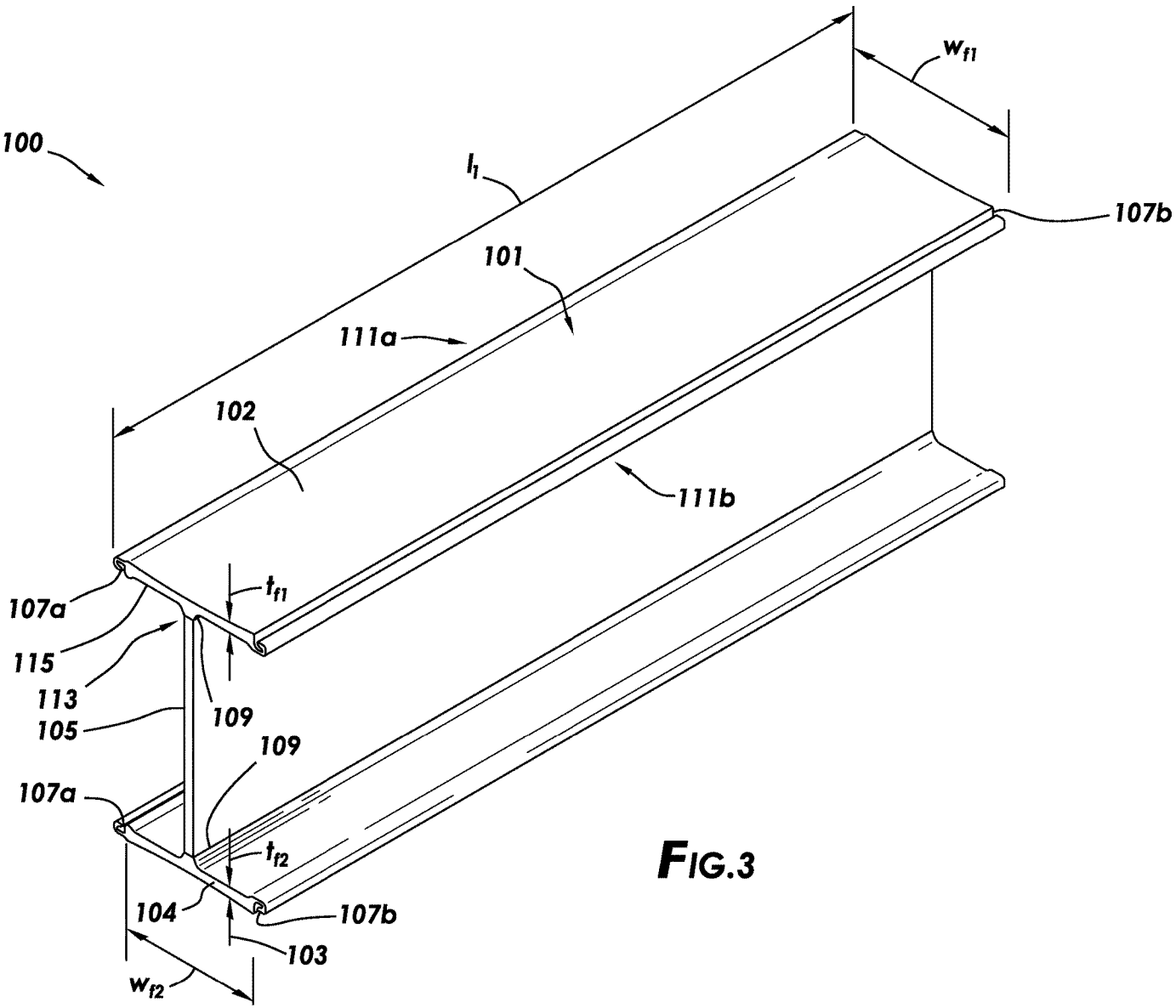
FIG. 3 depicts a perspective view of a king pile consistent with at least one embodiment of the present disclosure.
Figure 5:
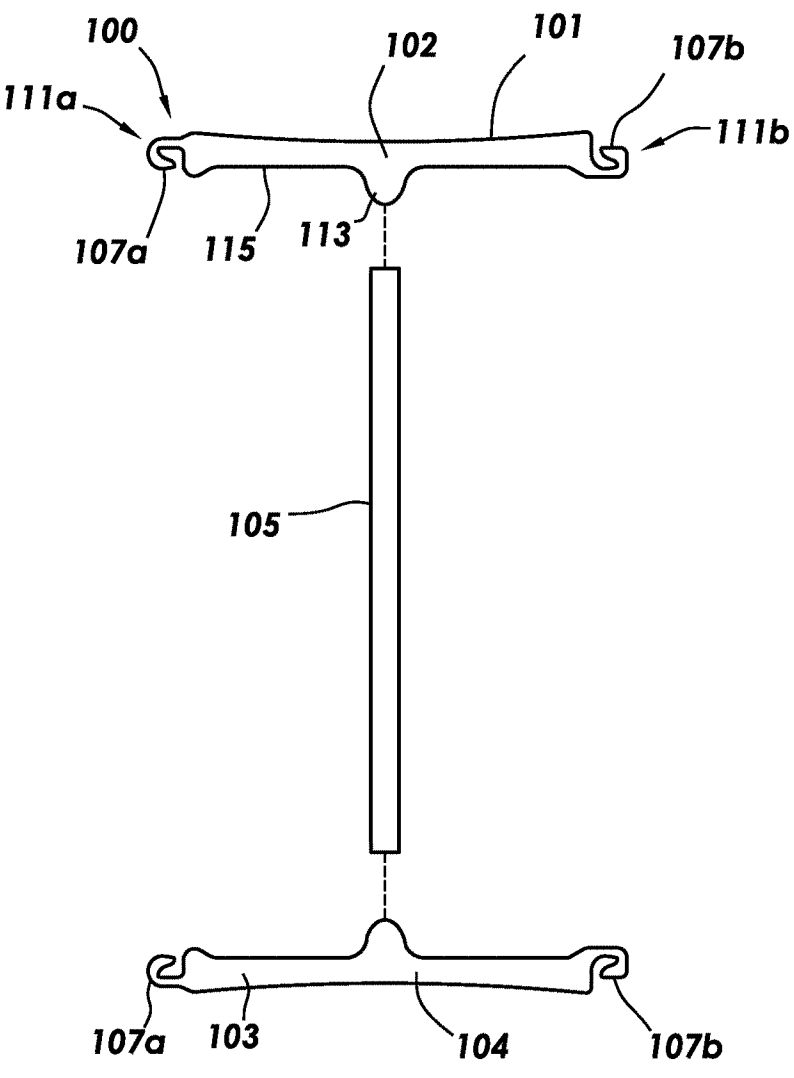
FIG. 5 depicts an end view of the king pile of FIG. 4 prior to assembly.
Figure 4:
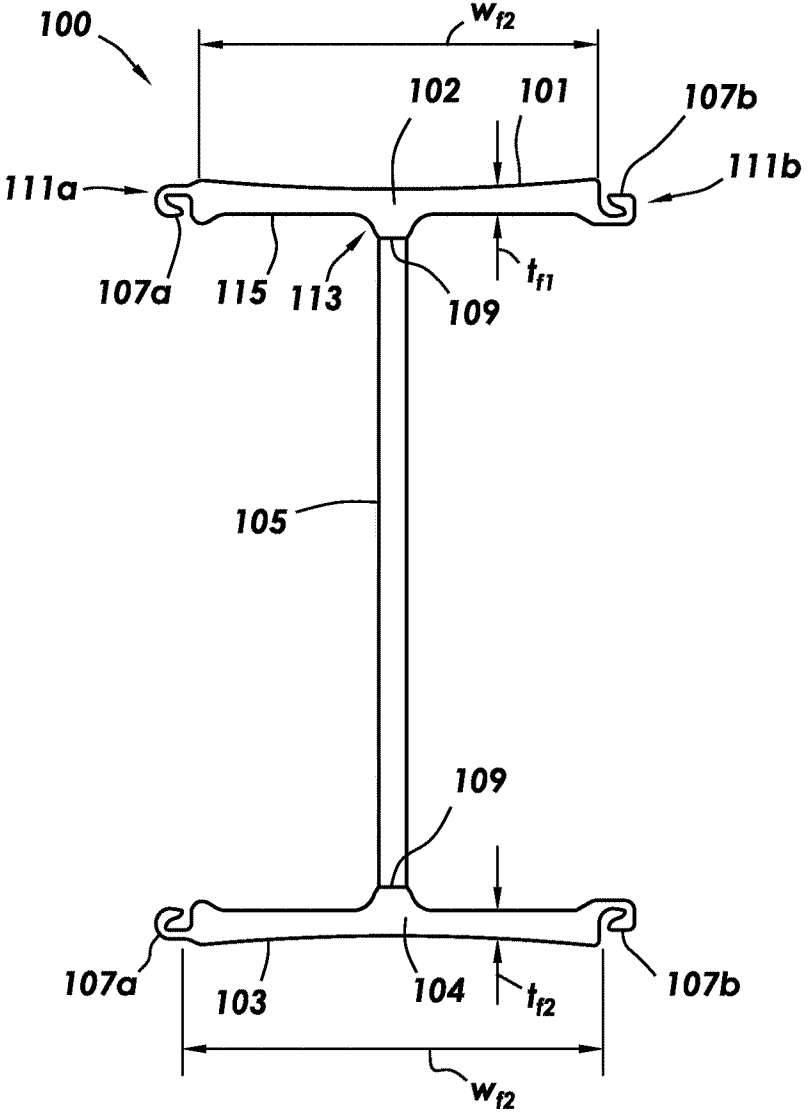
FIG. 4 depicts an end view of a king pile consistent with at least one embodiment of the present disclosure.

In some embodiments, as depicted in FIGS. 3-5, each king pile 100 may be formed from first flange 101, second flange 103, and web 105 to form an "H" shaped beam. First flange 101 may include first flange body 102 having a length $l_1$, width $w_{f1}$, and thickness $t_{f1}$. Second flange 103 may include second flange body 104 having a length $l_2$, width $w_{f2}$, and thickness $t_{f2}$. First flange body 102, second flange body 104, and web 105 may be generally rectangular plates. In some embodiments, first flange body 102 and second flange body 104 may each include king pile interlocks 107*a*, 107*b* formed integrally therewith. In some embodiments, as discussed further below, second flange 103 may be formed without king pile interlocks 107*a*, 107*b*. First flange 101, second flange 103, and web 105 may be formed separately as depicted in FIG. 5 and joined together as depicted in FIGS. 3, 4, by, for example and without limitation, longitudinal welds 109. In some embodiments, web 105 may be formed from a rectangular plate of cold or hot-rolled steel.

Figure 6:
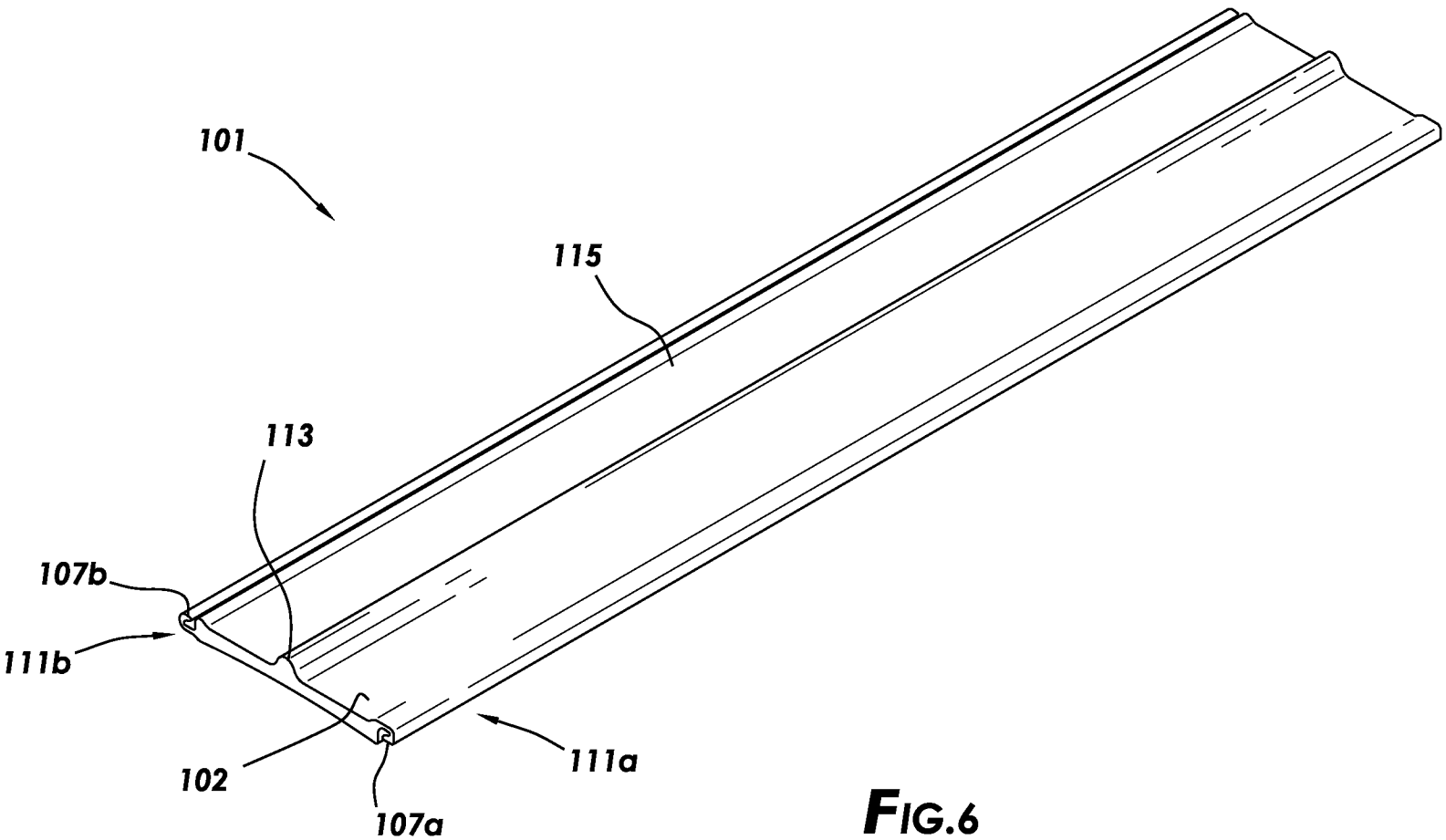
FIG. 6 depicts a perspective view of a flange of a king pile consistent with at least one embodiment of the present disclosure.
Figure 7:
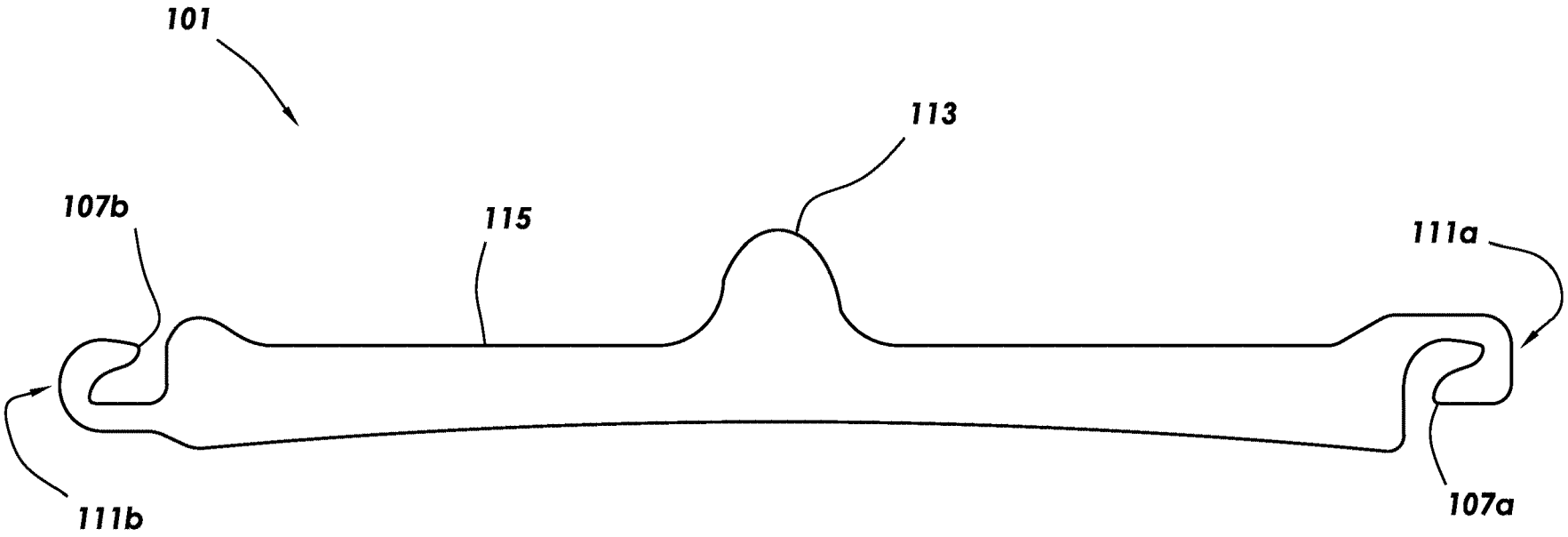
FIG. 7 depicts an end view of the flange of FIG. 6.

In some embodiments, as depicted in FIGS. 6, 7, first flange 101 (and second flange 103 where second flange 103 includes king pile interlocks 107*a*, 107*b*) may be formed such that king pile interlocks 107*a*, 107*b* are integrally formed at edges 111*a*, 111*b*, respectively, of first flange 101. For example and without limitation, first flange 101 may be formed by hot-rolling such that king pile interlocks 107*a*, 107*b* are formed into first flange body 102 as first flange body 102 is formed during the hot-rolling operation. By forming king pile interlocks 107*a*, 107*b* integrally with first flange body 102, additional manufacturing steps including, for example, welding of separate interlock connectors to an H-beam as in traditional king piles may be avoided, providing a stronger, lighter king pile with fewer potential weak-points compared to a traditional king pile.

In some embodiments, first flange 101 may include drop nose 113. Drop nose 113 may be an extension from flange face 115 of first flange body 102 that runs along the length of first flange 101. Drop nose 113 may, for example and without limitation, be used as the point of welding between first flange 101 and web 105 (as depicted by longitudinal welds 109 in FIG. 3). Without being bound to theory, drop nose 113 may, for example and without limitation, increase beam strength of first flange 101 prior to assembly of king pile 100, may increase the strength of longitudinal weld 109 by moving longitudinal weld 109 away from flange face 115 and thereby reducing stress concentration at the joint, and may provide a more convenient geometry for joining first flange 101 to web 105 by longitudinal weld 109.

Figure 8:
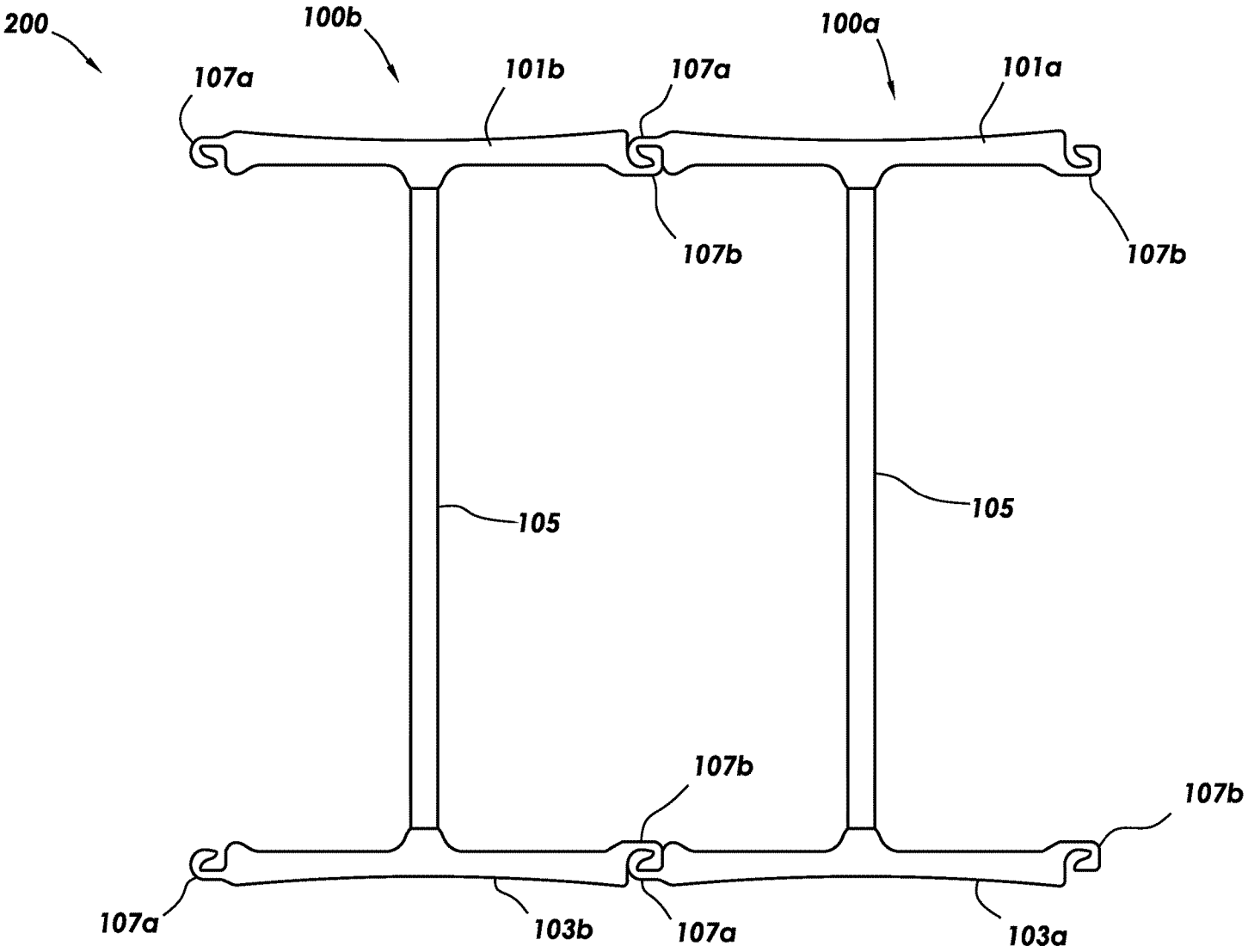
FIG. 8 depicts an end view of a king pile consistent with at least one embodiment of the present disclosure.
Figure 9:
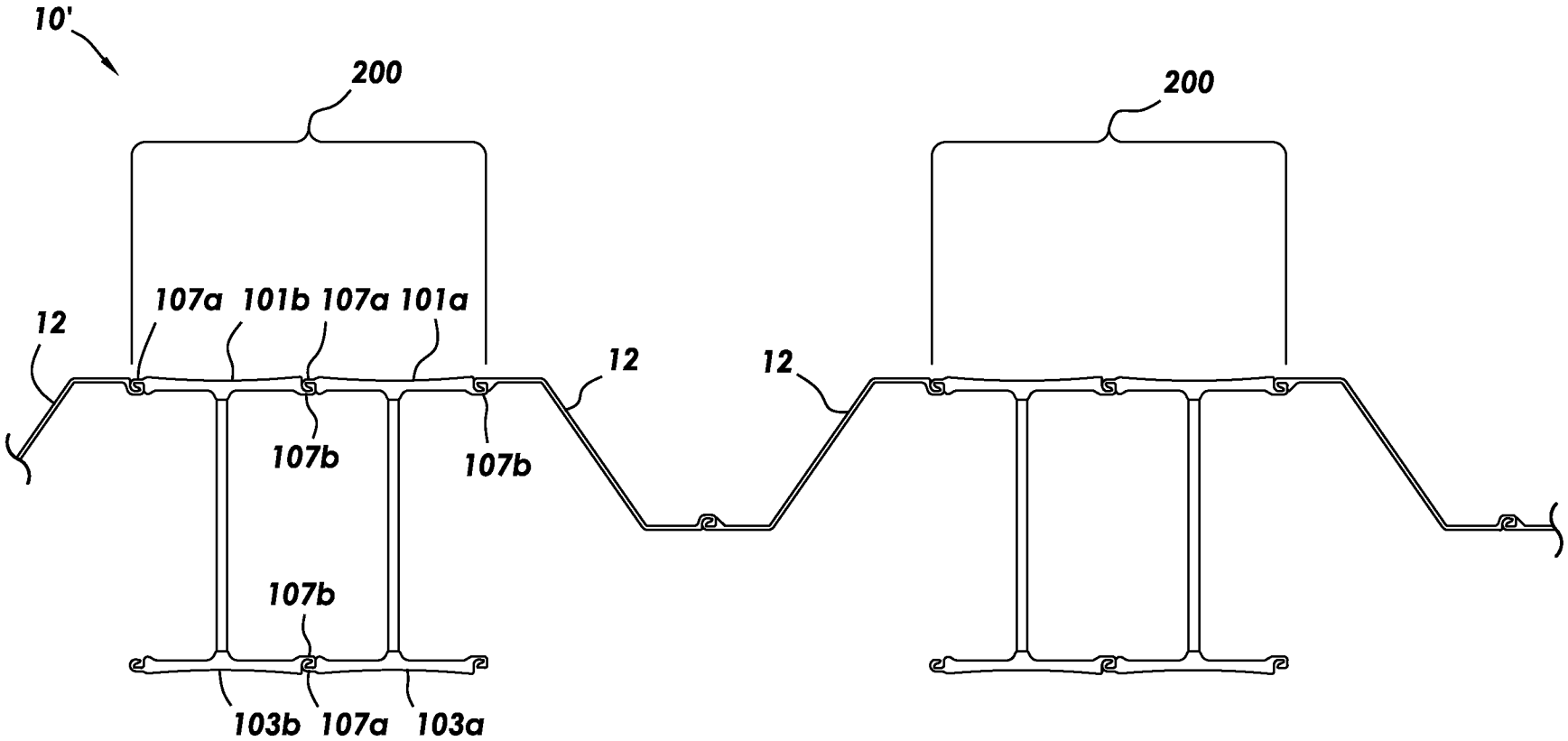
FIG. 9 depicts an end view of a combined wall system including a king pile consistent with at least one embodiment of the present disclosure.

In some embodiments, first flange 101 and second flange 103 may both include king pile interlocks 107*a*, 107*b*. In some such embodiments, as depicted in FIG. 8, double king pile 200 may be formed by interlocking two king piles 100*a*, 100*b* using king pile interlocks 107*a* of both first flange 101*a* and second flange 103*a* of king pile 100*a* to couple to king pile interlocks 107*b* of first flange 101*b* and second flange 103*b* of king pile 100*b*, respectively. Double king pile 200 may be used to form combined wall system 10' as depicted in FIG. 9 by coupling sheet pilings 12 to king pile interlock 107*b* of first flange 101*a* of king pile 100*a* and to king pile interlock 107*a* of first flange 101*b* of king pile 100*b*. Double king pile 200 may, for example and without limitation, provide additional structural support to combined wall system 10' as compared to combined wall system 10' as described herein above.

Figure 11:
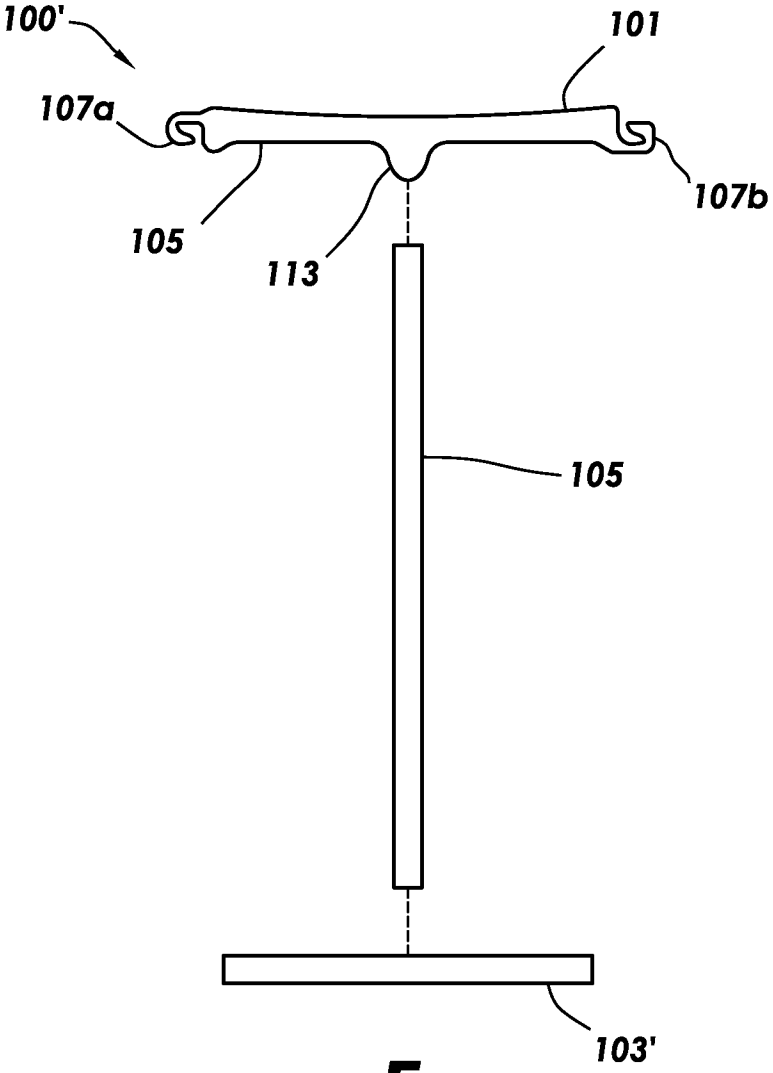
FIG. 11 depicts an end view of the king pile of FIG. 10 prior to assembly.
Figure 10:
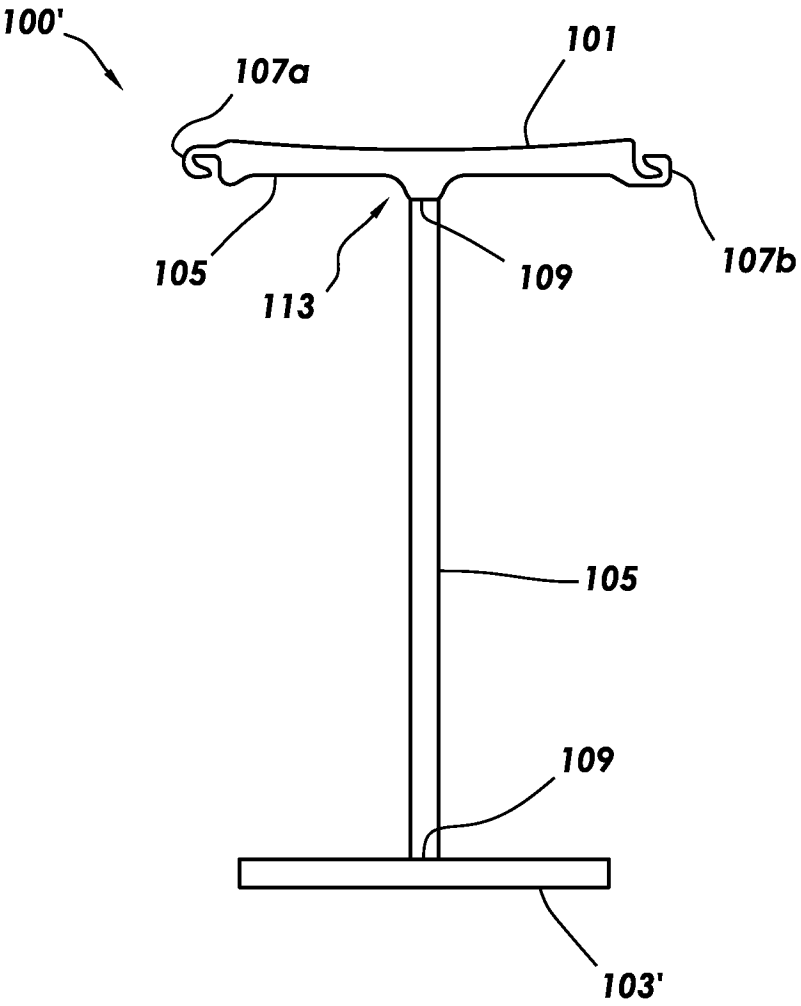
FIG. 10 depicts an end view of a king pile consistent with at least one embodiment of the present disclosure.

Because first flange 101 and second flange 103 are formed separately, first flange 101 and second flange 103 may, in some embodiments, have different configurations. For example, in some embodiments, first flange 101 and second flange 103 may be formed with different dimensions as further discussed below. In some embodiments, as depicted in FIGS. 10, 11, second flange 103' of king pile 100' may be formed as a rectangular sheet of cold or hot-rolled steel and may not include king pile interlocks 107*a*, 107*b*. In some embodiments, second flange 103' may include or may omit a drop nose.

Figure 12:
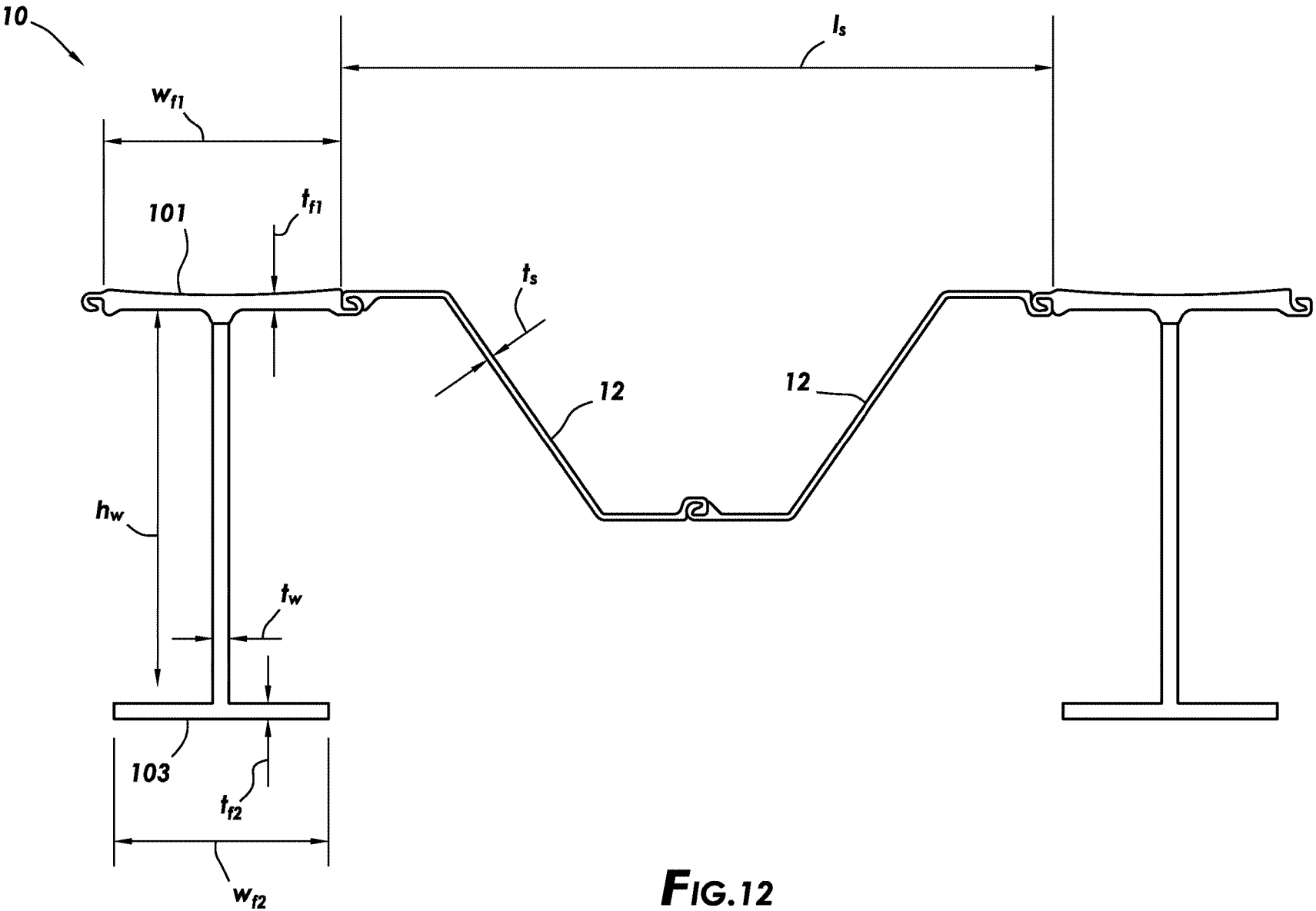
FIG. 12 depicts a partial view of a combined wall showing specification parameters of components thereof.
Figure 13A:
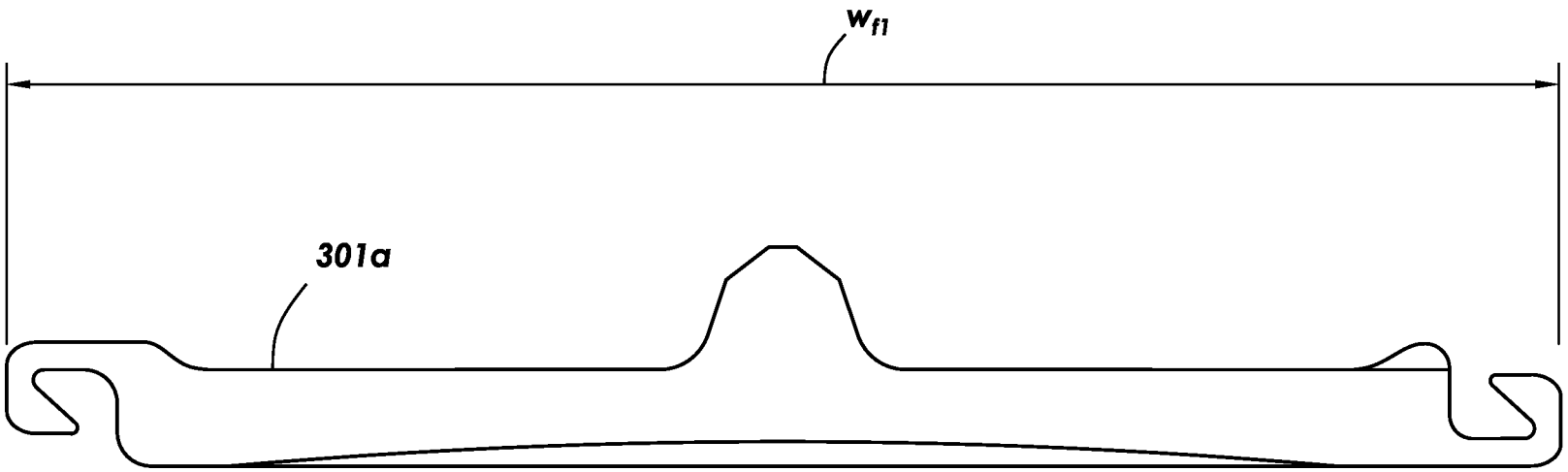
FIGS. 13A-C depict cross-sections of flanges of a king pile consistent with at least one embodiment of the present disclosure.
Figure 13B:
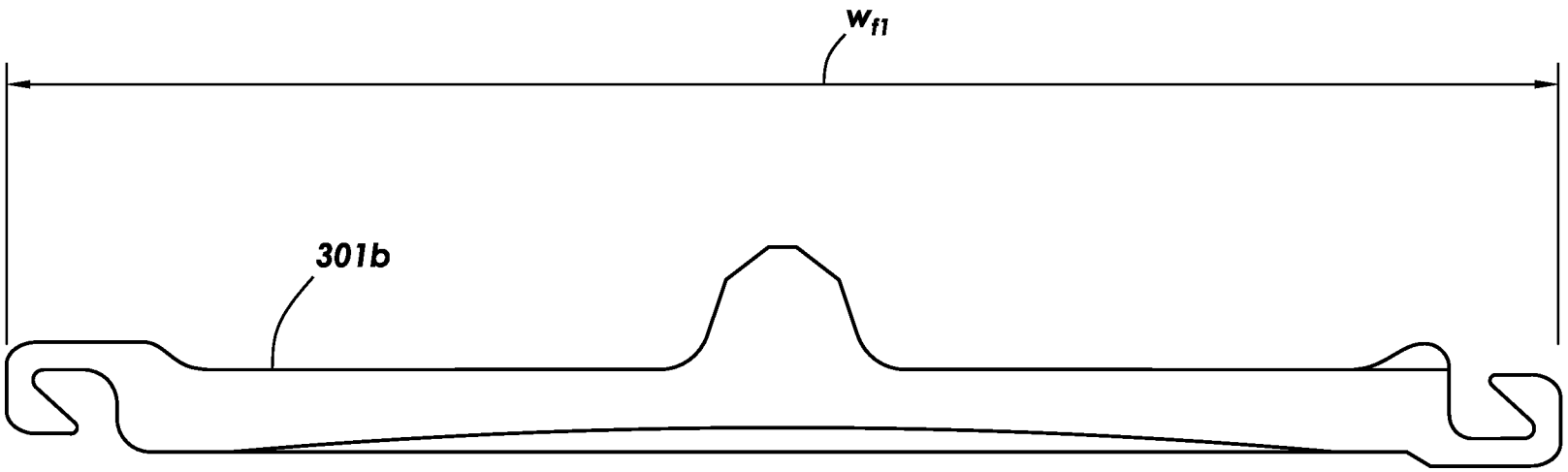
Figure 13C:
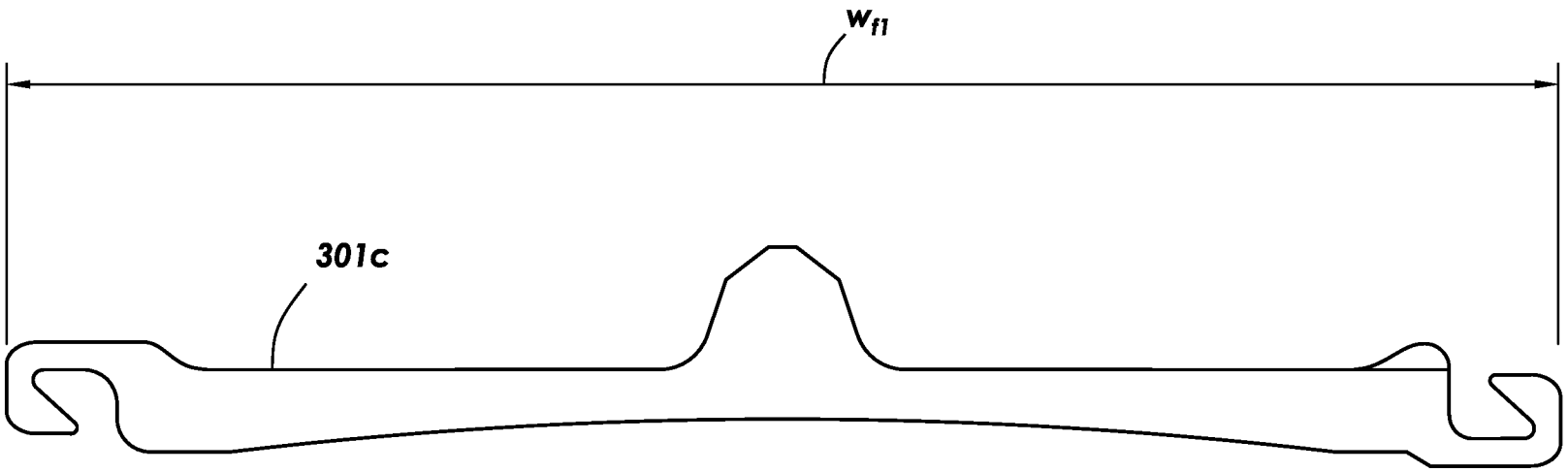

In some embodiments, first flange 101, second flange 103, web 105, and sheet pilings 12 may include one or more specification parameters, as outlined in FIG. 12, which may be selected with regard to the desired design specifications of combined wall system 10. For example and without limitation, the thickness of web 105 (web thickness $t_w$), height of web 105 (web height $h_w$), thickness of first flange 101 ($t_{f1}$), width of first flange 101 ($w_{f1}$), thickness of second flange 103 ($t_{f2}$) (here depicted as plain second flange 103'), width of second flange 103 ($w_{f2}$), type of sheet piling 12, thickness of sheet piling 12 ($t_s$), and length of sheet piling section ($l_s$) may be varied by utilizing components having different specification parameters to form king pile 100 and combined wall system 10 having desired properties. In some embodiments, first flange 101 may be selected from a plurality of flanges having different cross-sections and may therefore have different weights and strengths depending on configuration. For example, in some embodiments, first flange 101 may be produced in heavy cross-section 301*a*, medium cross-section 301*b*, or light cross-section 301*c*, depicted in FIGS. 13A-C, respectively. In such an embodiment, light cross-section 301*c* may use less amount of material than medium cross-section 301*b*, which may in turn use less material than heavy cross-section 301*a* despite other design specifications (such as width $w_{f1}$) remaining the same. By tailoring the specification parameters of combined wall system 10 to the intended use of combined wall system 10, a combined wall system 10 may be designed that more efficiency uses material than standardized parts, and may therefore, for example and without limitation, reduce unnecessary weight and costs in the procurement, transportation, and handling of the components of combined wall system 10.

For example and without limitation, in some embodiments, web 105 may be provided in thicknesses ($t_w$) between 0.3125" and 0.750" in 0.125" increments and in heights ($h_w$) between 20" and 45" in 1" increments. Second flange 103', where a plain rectangular plate is used, may, for example and without limitation, be provided in one or more thicknesses ($t_{f2}$) including, for example and without limitation 0.875", 1.0", and 1.1875".

In some embodiments, configuration tool 400 as depicted in FIG. 14 may be used to determine design specifications for components of combined wall system 10. Configuration tool 400 may be stored on a non-transitory, tangible permanent memory medium that includes computer program instructions for a computer device. In some embodiments, one or more pieces of data about the desired combined wall system 10 and its environment including, for example and without limitation, geomechanical soils data and loading data, may be used as inputs into configuration tool 400. In some embodiments, configuration tool 400 may include multiple input parameters. For example and without limitation, configuration tool 400 may include a pile selection tool with inputs such as single or double-king pile systems, type of sheet piling (ZZ Sheet), moment of inertia, section modulus, and maximum pile section depth. In some embodiments, configuration tool 400 may include a sheet pile wall tool with inputs such as cantilever or anchored style wall, single or double-king pile systems, type of sheet piling, wall height, beam length, beam/sheet ratio, wall length, minimum material grade, section height, active and passive water level, soil density, soil friction angle, safety factor, maximum deflection, and maximum pile section depth. In some embodiments, configuration tool 400 may include a corrosion tool with inputs such as type of sheet piling, corrosion rate, maximum moment, and maximum shear. In some embodiments, configuration tool 400 may include a pile cap cost tool with inputs such as pile cap dimensions, reinforcement ratio, and configured cross section.

Figure 15:
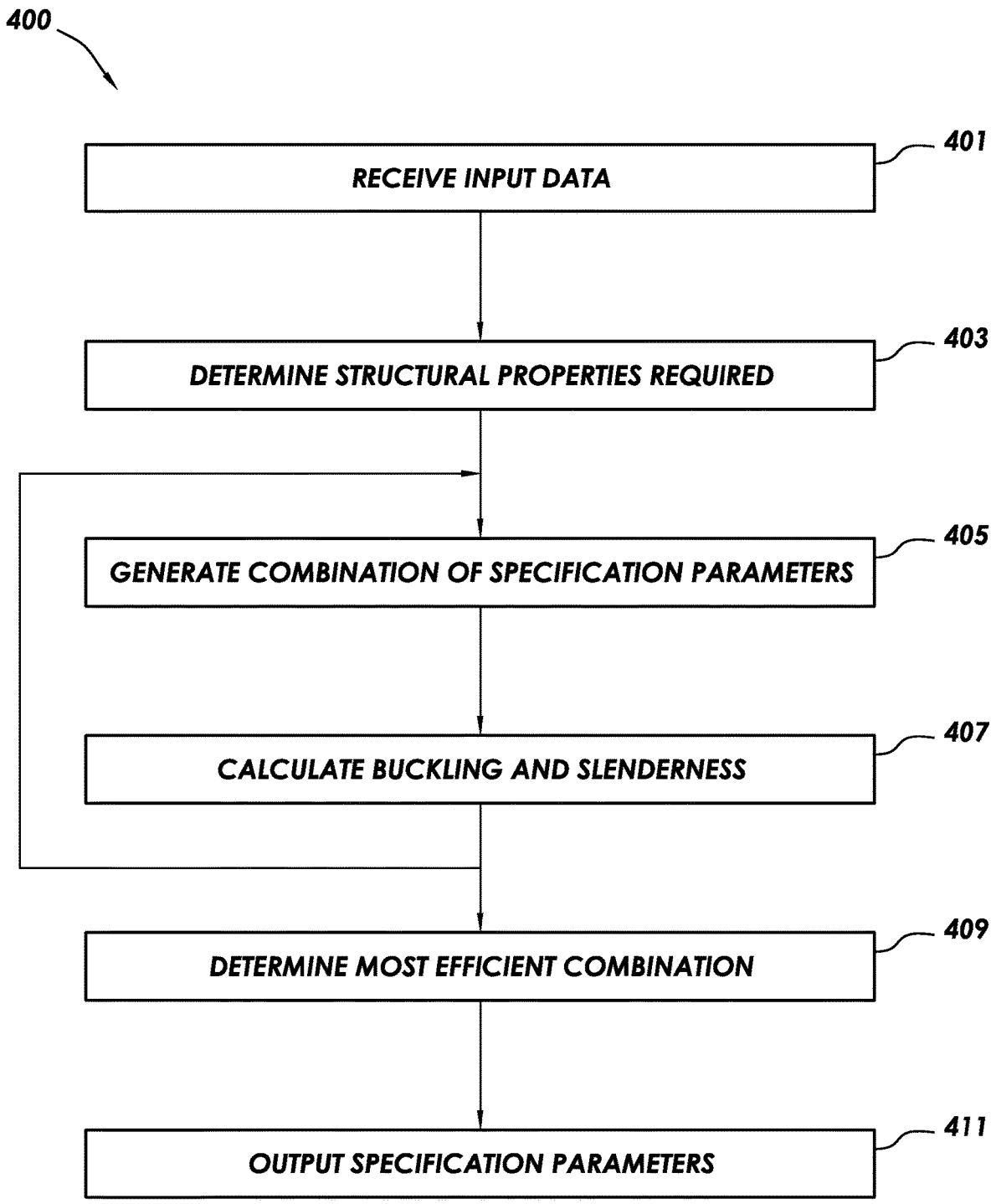
FIG. 15 depicts a flow chart for a configuration tool consistent with at least one embodiment of the present disclosure.

As depicted in FIG. 15, once inputs have been entered (401), configuration tool 400 may determine the structural properties required for combined wall system 10 to meet the design requirements (403). Configuration tool 400 may then iteratively run calculations of different combinations of specification parameters for combined wall system 10 (405). The components corresponding to each set of specification parameters are checked for buckling and slenderness regarding height and thickness (407). In some embodiments, this operation may include, for example and without limitation, calculating the slenderness ratios between first flange 101, second flange 103, and web 105 to evaluate the propensity of king pile 100 having specification parameters of each set of specification parameters buckling under the anticipated load. In some embodiments, a minimum slenderness ratio may be specified. Configuration tool 400 may compare each of the components corresponding to each set of specification parameters to determine the most efficient combination of specification parameters that meets the design requirements (409). In some embodiments, configuration tool 400 may select, for example and without limitation, a combination of specification parameters that meets the minimum slenderness ratio for a beam design under the loading parameters that has the minimum thicknesses and heights. Configuration tool 400 may then communicate the determined most efficient combination of specification parameters (411) to the user by, for example and without limitation, a graphical user interface as depicted in FIG. 14.

Figure 16:
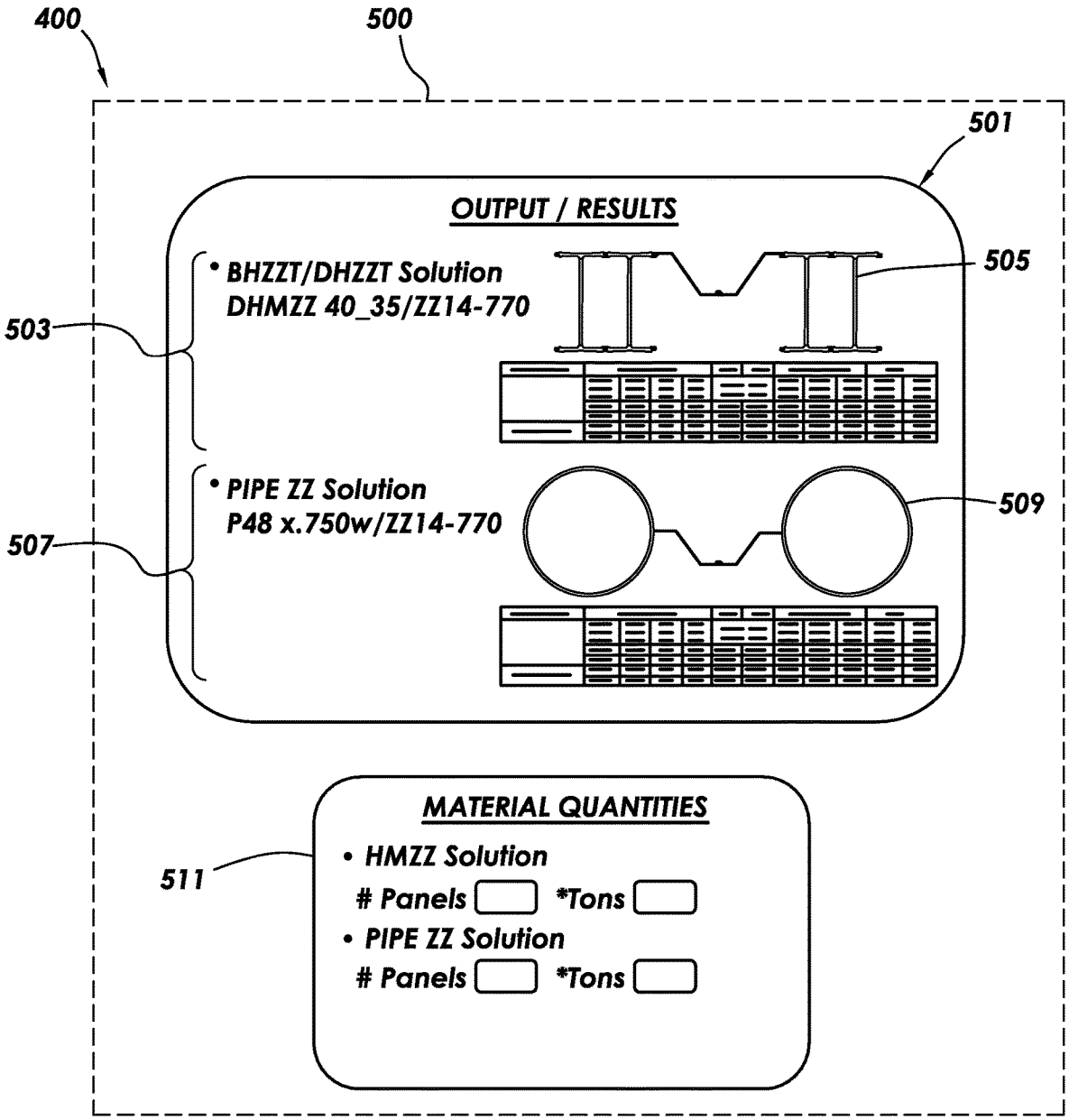
FIG. 16 depicts an output module for a configuration tool consistent with at least one embodiment of the present disclosure.

In some embodiments, as shown in FIG. 16, configuration tool 400 may include output module 500. Output module 500 may, in some embodiments display the most efficient combination of specification parameters. In some embodiments, output module 500 may generate one or more models 501 of a combined wall corresponding to the most efficient specification parameters. In some embodiments, output module 500 may provide a solution of a combined wall using both sheet pilings 12 and king piles 100, shown at 503 including model 505, as discussed herein above and pipe-piling solution 507, including model 509, to meet the required specifications. In some embodiments, output module 500 may include material requirement module 511, which may display the number of king piles 100 and sheet pilings 12 or pipe piles and sheet pilings 12 needed to complete the specified combined wall. In some embodiments, material requirement module 511 may output the overall weight of the materials of the combined wall.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A king pile for a combined wall system comprising:

a first flange, the first flange having:

a first flange body, the first flange body being a generally rectangular plate having a length and a width, the first flange body having a first edge, a second edge, and a face;

a drop nose, the drop nose being an extension from the face of the first flange body that runs along the length of the first flange, the drop nose formed integrally with the first flange body such that the thickness of the first flange body is greater at a region of the first flange body aligned with the drop nose than a region of the first flange body that is not aligned with the drop nose;

a first king pile interlock positioned at the first edge of the first flange body and formed integrally therewith; and a second king pile interlock positioned at the second edge of the first flange body and formed integrally therewith;

a second flange, the second flange having a second flange body, the second flange body being a generally rectangular plate having a face; and a web, the web being a generally rectangular plate, the web coupled to the drop nose faee of the first flange body and the face of the second flange body.

2. The king pile of claim 1, wherein the web is coupled to the face of the first flange body and the face of the second flange body by welding.

3. The king pile of claim 1, wherein the web is coupled to the drop nose by welding.

4. The king pile of claim 1, wherein the first flange is formed by hot-rolling the first flange body such that the first and second king pile interlocks are formed integrally with the first flange body during the hot-rolling operation.

5. The king pile of claim 1, wherein the first and second king pile interlocks are male and female Larssen interlocks.

6. The king pile of claim 1, wherein the second flange further comprises:

a second drop nose, the drop nose being an extension from the face of the second flange body that runs along the length of the second flange, the second drop nose formed integrally with the second flange body;

a third king pile interlock positioned at a first edge of the second flange body and formed integrally therewith; and a fourth king pile interlock positioned at a second edge of the second flange body and formed integrally therewith.

7. A method of forming a king pile comprising:

forming a first flange, wherein forming the first flange comprises:

forming a first flange body, the first flange body being a generally rectangular plate having a length and a width, the first flange body having a first edge, a second edge, and a face;

forming a first king pile interlock positioned at the first edge of the first flange body; and forming a second king pile interlock positioned at the second edge of the first flange body;

forming a drop nose, the drop nose being an extension from the face of the first flange body that runs along the length of the first flange;

the first flange formed such that the first king pile interlock, and second king pile interlock, and drop nose are formed integrally with the first flange body such that the thickness of the first flange body is greater at a region of the first flange body aligned with the drop nose than a region of the first flange body that is not aligned with the drop nose;

providing a second flange, the second flange having a second flange body, the second flange body being a generally rectangular plate having a face;

providing a web, the web being a generally rectangular plate;

coupling the web to the drop nose of the first flange body; and coupling the web to the face of the second flange body.

8. The method of claim 7, wherein coupling the web to the face of the first flange body comprises welding the web to the face of the first flange body, and wherein coupling the web to the face of the second flange body comprises welding the web to the face of the second flange body.

9. The method of claim 7, wherein coupling the web to the drop nose comprises welding the web to the drop nose.

10. The method of claim 7, wherein forming the first flange comprises hot-rolling such that the first and second king pile interlocks are formed integrally with the first flange body during the hot-rolling operation.

11. The method of claim 7, wherein the first and second king pile interlocks are male and female Larssen interlocks.

12. The method of claim 7, wherein providing a second flange further comprises:

forming the second flange body;

forming a third king pile interlock positioned at a first edge of the second flange body;

forming a fourth king pile interlock positioned at a second edge of the second flange body;

forming a second drop nose, the second drop nose being an extension from the face of the second flange body that runs along the length of the second flange;

the second flange formed such that the first king pile interlock, second king pile interlock, and drop nose are formed integrally with the second flange body; and wherein coupling the web to the face of the second flange body comprises coupling the web to the second drop nose of the second flange.

13. A combined wall system comprising:

a king pile, the king pile including:

a first flange, the first flange having:

a first flange body, the first flange body being a generally rectangular plate having a length and a width, the first flange body having a first edge, a second edge, and a face;

a drop nose, the drop nose being an extension from the face of the first flange body that runs along the length of the first flange, the drop nose formed integrally with the first flange body such that the thickness of the first flange body is greater at a region of the first flange body aligned with the drop nose than a region of the first flange body that is not aligned with the drop nose;

a first king pile interlock positioned at the first edge of the first flange body and formed integrally therewith; and a second king pile interlock positioned at the second edge of the first flange body and formed integrally therewith;

a second flange, the second flange having a second flange body, the second flange body being a generally rectangular plate having a face; and a web, the web being a generally rectangular plate, the web coupled to the drop nose of the first flange body and the face of the second flange body; and a sheet piling, the sheet piling including an interlock connector, the interlock connector coupled to the first king pile interlock.

14. The combined wall system of claim 13, wherein the web is coupled to the face of the first flange body and the face of the second flange body by welding.

15. The combined wall system of claim 13, wherein the web is coupled to the drop nose by welding.

16. The combined wall system of claim 13, wherein the first flange is formed by hot-rolling the first flange body such that the first and second king pile interlocks are formed integrally with the first flange body during the hot-rolling operation.

17. The combined wall system of claim 13, wherein the first king pile interlock and the interlock connector are male and female Larssen interlocks.

18. The combined wall system of claim 13, wherein the second flange further comprises:

a second drop nose, the drop nose being an extension from the face of the second flange body that runs along the length of the second flange, the second drop nose formed integrally with the second flange body;

a third king pile interlock positioned at a first edge of the second flange body and formed integrally therewith; and a fourth king pile interlock positioned at a second edge of the second flange body and formed integrally therewith.

19. The combined wall system of claim 18, further comprising:

a second king pile, the second king pile including:

a third flange, the third flange having:

a third flange body, the third flange body being a generally rectangular plate having a length and a width;

a third drop nose, the third drop nose being an extension from the face of the third flange body that runs along the length of the third flange, the third drop nose formed integrally with the third flange body;

a fifth king pile interlock positioned at a first edge of the third flange body and formed integrally therewith; and a sixth king pile interlock positioned at a second edge of the third flange body and formed integrally therewith;

a fourth flange, the fourth flange having:

a fourth flange body, the fourth flange body being a generally rectangular plate having a length and a width;

a fourth drop nose, the fourth drop nose being an extension from the face of the fourth flange body that runs along the length of the fourth flange, the fourth drop nose formed integrally with the fourth flange body;

a seventh king pile interlock positioned at a first edge of the fourth flange body and formed integrally therewith; and an eighth king pile interlock positioned at a second edge of the fourth flange body and formed integrally therewith; and a second web, the second web being a generally rectangular plate, the second web coupled to the third drop nose of the third flange body and the fourth drop nose of fourth flange body;

wherein the second king pile interlock is coupled to the fifth king pile interlock and the fourth king pile interlock is coupled to the seventh king pile interlock.

* * * * *